United States Patent [19]

Downing, Jr.

[11] 4,067,156

[45] Jan. 10, 1978

[54] COMPUTER FLOOR STRUCTURE

[75] Inventor: Lucien R. Downing, Jr., Avon Lake, Ohio

[73] Assignee: Donn Products, Inc., Westlake, Ohio

[21] Appl. No.: 648,045

[22] Filed: Jan. 12, 1976

[51] Int. Cl.[2] ..... E04B 5/08; E04C 2/06

[52] U.S. Cl. ..... 52/126; 52/602; 52/263

[58] Field of Search ..... 52/602, 603, 126, 328, 52/263; 404/43

[56] References Cited

U.S. PATENT DOCUMENTS

| | | | |
|---|---|---|---|
| 776,419 | 11/1904 | Platt | 52/603 |
| 1,031,043 | 7/1912 | Conzelman | 52/602 |
| 1,231,348 | 6/1917 | Hernandez | 52/602 |
| 1,972,563 | 9/1934 | Irvin | 52/145 |
| 2,159,991 | 5/1939 | Hilpert | 52/602 |
| 2,230,153 | 1/1941 | Allbright et al. | 52/319 |
| 2,522,116 | 9/1950 | Hayes | 264/42 |
| 3,811,237 | 5/1974 | Bettinger | 52/126 |

FOREIGN PATENT DOCUMENTS

| | | | |
|---|---|---|---|
| 1,001,569 | 10/1951 | France | 52/328 |
| 312,293 | 5/1929 | United Kingdom | 404/43 |

*Primary Examiner*—James L. Ridgill, Jr.
*Attorney, Agent, or Firm*—McNenny, Pearne, Gordon, Gail, Dickinson & Schiller

[57] ABSTRACT

A panel for elevated access floors is disclosed in which the panel is formed of reinforced expanded lightweight concrete. The reinforcing is provided by a grid including two arrays of parallel reinforcing rods which extend parallel to the associated panel edges and perpendicular to the rods of the other grid. A frame is provided by the grid around the two arrays. The grid is located adjacent to the lower surface of the body and divides the body into a plurality of square zones. Located in each zone, excepting the zones at the corners, is a pyramid-shaped cavity which extends from a base at the lower surface of the panel upwardly at about 45° to an apex spaced from the upper surface of the panel. The presence of the pyramid-shaped cavities does not materially reduce the strength of the panel when compared to a similar panel without such cavities, but reduces the weight of the panel and the material required to manufacture the panel.

10 Claims, 7 Drawing Figures

Fig. 1
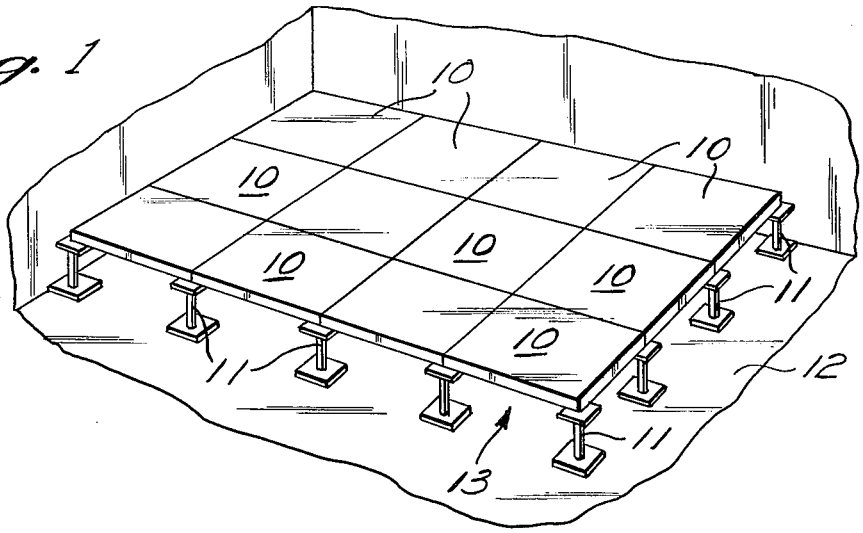
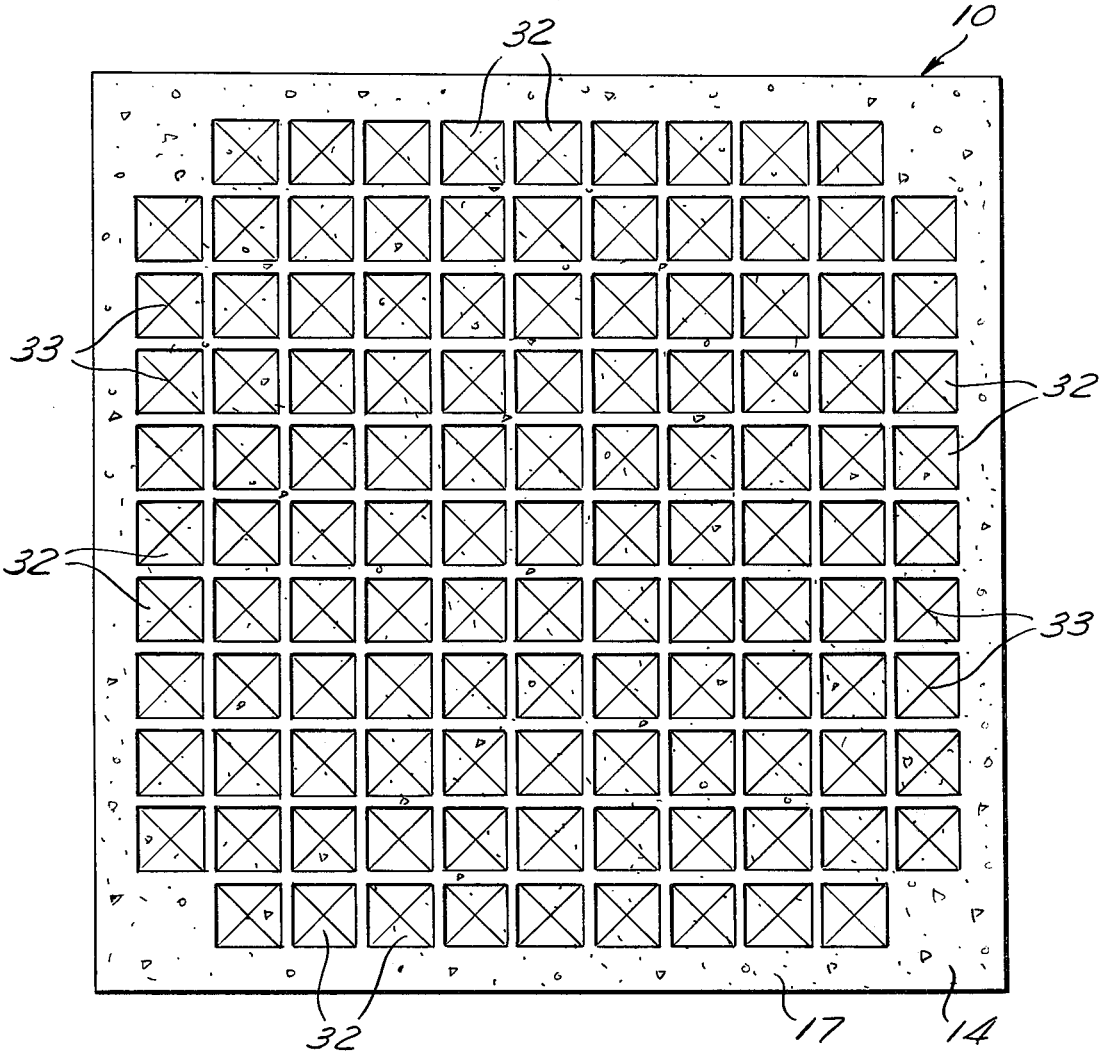
Fig. 2

Fig. 3
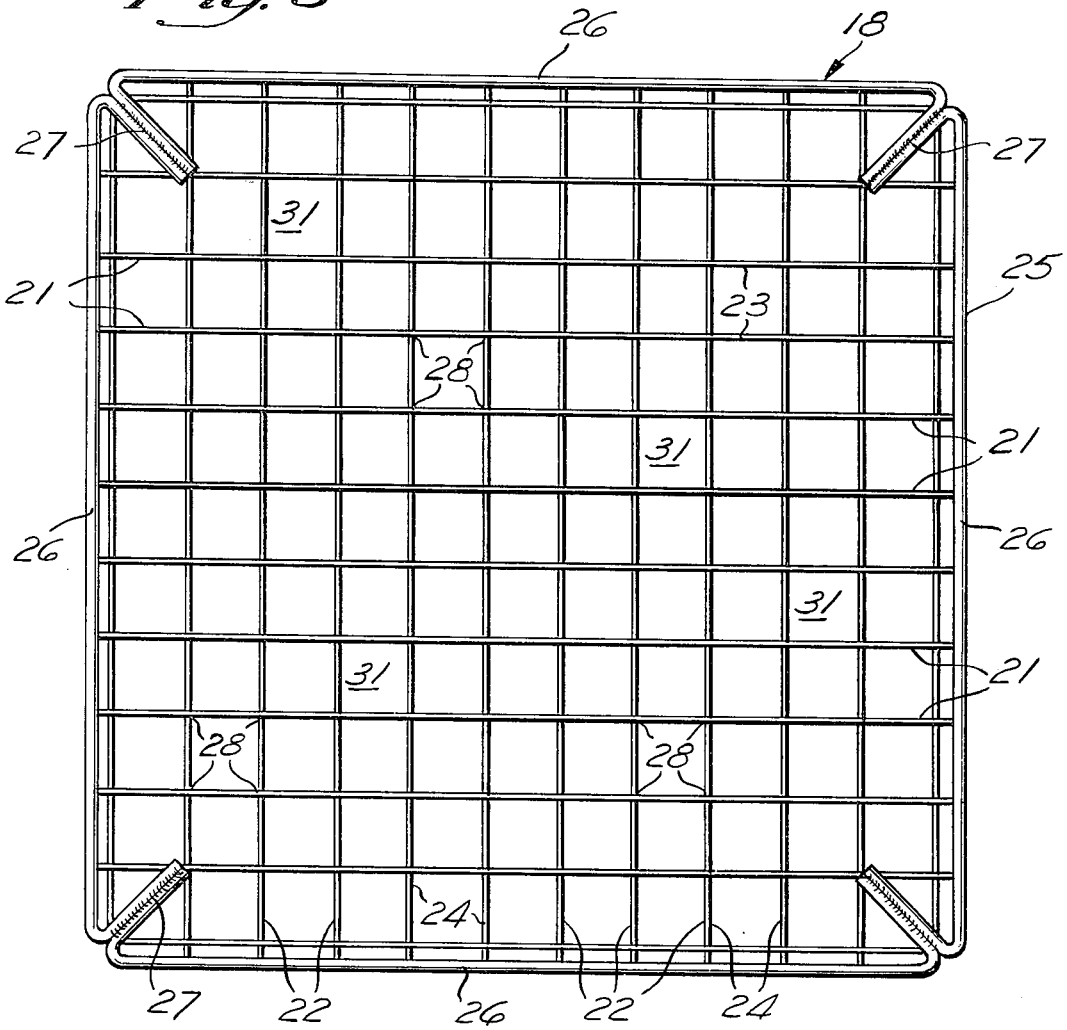
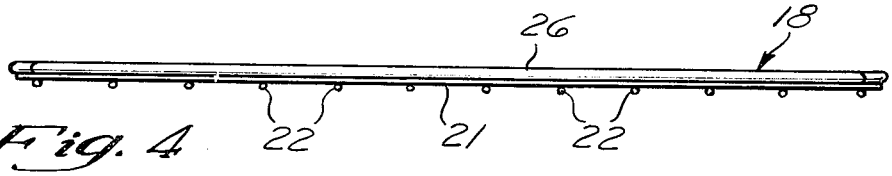
Fig. 4
Fig. 5
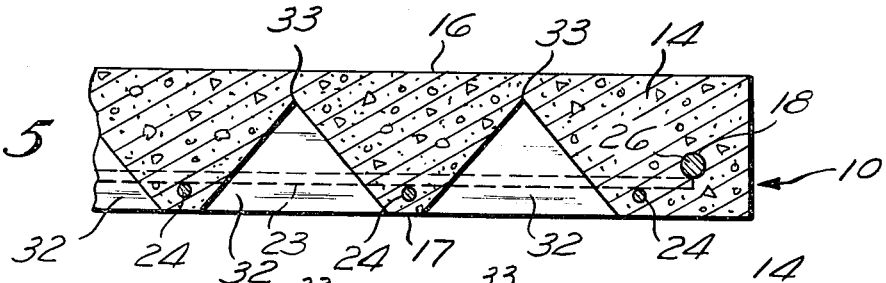
Fig. 7
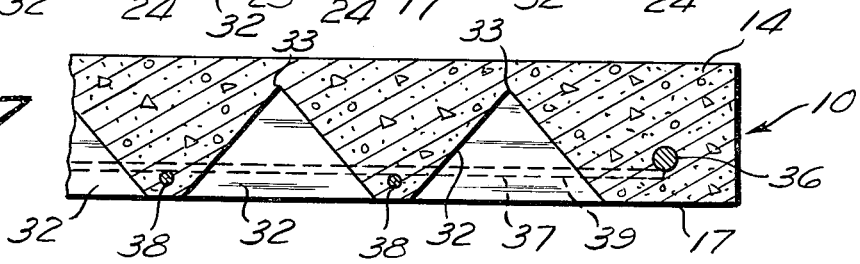

COMPUTER FLOOR STRUCTURE

BACKGROUND OF THE INVENTION

This invention relates generally to panels for buildings or the like, and more particularly to a novel and improved floor panel for use in elevated floor structures, sometimes referred to as access floors or pedestal floors.

PRIOR ART

Usually elevated floor systems consist of a plurality of rectangular or square panels supported by pedestals at their corners above the floor structure of the building. The panels are removable to provide access to the various services which run below the elevated floor.

Such floor panels are often formed of metal provided with rib grids to provide strength without excessive weight. Examples of such panels are disclosed in the U.S. Pat. Nos. 3,025,934; 3,279,134; 3,295,272; 3,568,390 and 3,696,578. Such floor panels tend to be expensive and do not provide effective fire barriers because of the high thermal conductivity of metal. Even though the metal itself is non-flammable, heat of a fire on one side of the panel is rapidly transmitted through the panel to the other side.

Other panels are formed of a core material such as wood, composition board, or honeycomb. Usually the core material is encased in such structures. Examples of such panels are disclosed in the U.S. Pat. Nos. 3,065,506; 3,548,559 and 3,789,557. Such panels tend to be expensive and/or heavy. Further, when they are formed of flammable material, they present a fire hazard.

Still other panels are formed of concrete or the like. Examples of such panels are illustrated in the U.S. Pat. Nos. 3,066,448; 3,216,157; 3,681,882 and 3,811,237. Such panels provide good fire protection, but are heavy, even when formed with expanded concrete and reinforcing rods, as disclosed in the latter two of such patents.

SUMMARY OF THE INVENTION

In accordance with the present invention, a novel and improved floor panel for elevated floors or the like is formed of reinforced concrete. Such panel provides high strength, high fire resistance, and can be manufactured at low cost. Preferably light-weight, expanded concrete is used to reduce the concrete weight and the concrete is formed with cavities in the lower surface to reduce the panel weight and material costs.

The reinforcing rods and cavities are arranged so that the panel strength is substantially the same as a similar panel without recesses. Therefore, the weight and cost reduction obtained by the cavity is realized without loss of strength.

In the illustrated embodiments, the panel is square and a reinforcing grid is located adjacent to the lower surface, in which the grid is provided with two perpendicular arrays of reinforcing elements which divide the panel into similar square zones. The cavities, or recesses, are located within the zones and have a pyramid shape with sides that slope inward at an angle of about 45° to an apex spaced from the upper panel surface. The elimination of the concrete material, which would otherwise occupy the cavities, does not significantly reduce the strength of the panel because the stress pattern within the concrete and reinforcing rods is such that the eliminated material would not contribute to panel strength.

In one illustrated embodiment, extra reinforcing is provided at the corners where the panel is supported.

BRIEF DESCRIPTION OF THE DRAWINGS

FIG. 1 is a fragmentary perspective view schematically illustrating an access or elevated floor system of the type in which the panels of the present invention are particularly useful;

FIG. 2 is a view of a panel incorporating this invention from the lower side;

FIG. 3 is a plan view of one preferred form of grid which is embedded in the concrete of the panel illustrated in FIG. 2;

FIG. 4 is a side elevation of the grid illustrated in FIG. 3;

FIG. 5 is an enlarged fragmentary cross section of a panel incorporating the grid of FIGS. 3 and 4;

DETAILED DESCRIPTION OF THE DRAWINGS

Figure 6:
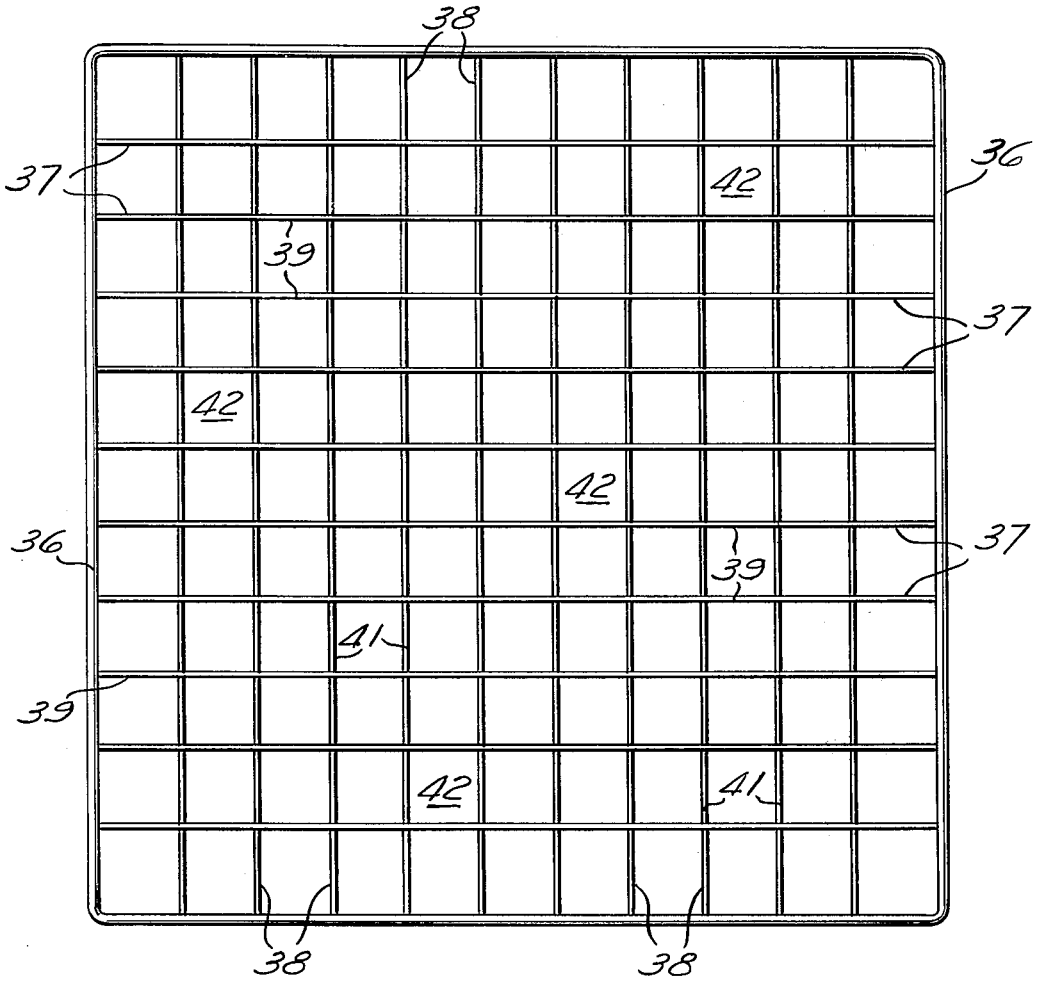
FIG. 6 is a plan view of a second embodiment of grid for use in the panel of FIG. 2; and, FIG. 7 is a fragmentary cross section similar to FIG. 5, but illustrating a panel incorporating the grid of FIG. 6.

FIG. 1 is a schematic illustration of an elevated access floor of the type utilizing floor panels in accordance with the present invention. In such a floor system, a plurality of rectangular or square panels 10 are supported at their corners by pedestals 11 and cooperate to provide a continuous floor surface, which is spaced from the main floor 12 of the building. The panels 10 are removable to provide access to the area 13 between the elevated floor panels 10 and the main building floor 12. Such elevated access floor systems are often used in computer rooms or the like, since the various services such as heating, air conditioning, wiring and the like are installed in the zone 13 below the floor. Repair or alterations in such services is easily accomplished by merely removing the appropriate panels 10 to provide the access to the service involved.

FIG. 2 is a bottom view of a preferred panel 10, in accordance with the present invention. Such panel is square and is formed with a cross section, best illustrated in FIGS. 5 and 7. The panel is formed of a body of concrete material or the like 14, having a planar upper load-bearing surface 16 and a lower or rearward surface 17. Embedded within the body 14 is a reinforcing grid 18, best illustrated in FIGS. 3 and 4. The grid is formed of two arrays 21 and 22 of iron rods 23 and 24, respectively. In the illustrated embodiment, the array 21 includes twelve rods 23, which extend parallel to each other with a two-inch spacing. Similarly, the array 22 includes twelve rods with two-inch spacings, which extend parallel to each other and perpendicular to the rods 23.

Around the two arrays is a frame, or border 25 of heavier reinforcing rod. The frame 25 is provided by four similar frame rods 26, which cooperate to form a square and are inturned at their ends and welded together at 27. The ends 27 extend diagonally in from the frame at about 45°. The entire grid is welded together so that the ends of the rods 23 and 24 are secured to the frame 25 and are also welded together at each intersection within the grid, such as the intersections 28. In the illustrated embodiment, the panel or slab is two foot square and one and one-quarter inches thick. The frame 25 is symmetrically positioned within the slab with the frame elements 26 spaced in from the lateral edges by about five-eighths of an inch. The grid 18 is embedded within the body 14 substantially adjacent to the lower or rearward surface 17. In the illustrated embodiment, the grid elements 23 and 24 are about seven thirty-seconds of an inch from the lower surface 17. The frame is preferably formed of rod about one-quarter of an inch in diameter and the elements 23 and 24 are preferably about fourteen gauge wire.

The two arrays 23 and 24 cooperate to divide the panel into a plurality of square zones 31, as best illustrated in FIG. 3. Located within each zone 31, excepting the zones at the corners, is a regular pyramid shaped cavity 32, which is open at its base to the rearward surface 17 and extends to an apex 33 spaced from the upper surface 16 of the panel. Preferably the sides of the pyramids 32 are sloped with respect to the rearward face 17 at an angle of about 45°. The spacing between the apex 33 of each pyramid and the upper surface is about one-quarter of an inch and the spacing between the bases of the pyramids and the adjacent pyramids is about one-quarter of an inch. As best illustrated in FIG. 2, there is a pyramid located in each zone excepting at the four corners of the panel. The four corners, on the other hand, are filled in, since it is at the corners that the panel rests upon the pedestals 11. By forming the frame 25 with the inturned ends at 27, extra reinforcing is provided at the four corners where the panels are supported on the pedestals.

The embodiment of FIGS. 6 and 7 differs from the embodiment of FIGS. 3 through 5, in that a different grid is provided. The grid of the second embodiment is preferably shaped as illustrated in FIG. 6. Such grid has a simple square frame 36, preferably formed of quarter-inch rod and is about one foot eleven inches on each side. Two arrays, 37 and 38, have parallel rod or wire elements 39 and 41 respectively, and cooperate with the frame to provide the grid. In this embodiment, there are ten rods 39 in the array 37, which extend parallel to each other on two-inch spacing with the outermost rods of the array spaced from the adjacent frame side by about two and one-half inches. Similarly, the array 38 is provided with ten rods 41, arranged with the same spacing as the array 37. Here again, the two arrays 37 and 38 cooperate to divide the panel into a plurality of substantially square zones 42 and the body 14 is formed with an identical pattern of pyramid shaped cavities 32, as in the first embodiment, so the external appearance of the slab or panels provided by the two different grids is identical. The principal difference is that the grid of FIGS. 6 and 7 does not provide the extra reinforcement along the edges and at the corners, which is provided by the grid of FIGS. 3 and 4.

It has been determined that the overall strength of a panel in accordance with this invention is not materially reduced by the presence of the cavities. This is because concrete, although strong in compression, is weak in tension. Consequently, substantially the entire tensile stress in the panel is carried by the grid and for practical purposes, only compressor stress is carried by the concrete body.

With the illustrated structure in which the grid forms square zones, the distribution of stresses in the concrete results in a compressive stress distribution which broadens upwardly on an angle of about 45° from each reinforcing element. Consequently, if concrete material were located within the space occupied by the pyramid shaped cavities, having sides sloping at about 45°, it would be stressed in tension and would not contribute significantly to the total strength of the panel. Therefore, a panelling incorporating this invention is substantially as strong as a similar panel without cavities.

The presence of the cavities permits substantial weight reductions in the panel and also results in cost savings, since the material required to form the panel is reduced. Further, the low heat transfer property of concretelike material gives the panel high fire resistance.

Although preferred embodiments of this invention are illustrated, it should be understood that various modifications and rearrangements of parts may be resorted to without departing from the scope of the invention disclosed and claimed herein.

What is claimed is:

1. A generally rectangular floor panel adapted to be supported at its corners comprising a body of nonflammable concrete-like material having substantial compressive strength, low tensile strength and a low co-efficient of thermal transfer, said body having a planar upper surface and a lower surface, a grid of reinforcing elements embedded in said body substantially adjacent said lower surface arranged in arrays of elements which divide said panel into a plurality of reinforcing element bounded zones, said body being formed with a plurality of cavities within said zones which are open to said lower surface and are substantially uniformly sloped inward and upward toward said upper surface at an angle with respect to said lower surface substantially no greater than 45°, said cavities terminating at a location spaced from said upper surface, said body providing a substantially homogeneous upper portion above said cavities of substantially uniform thickness and integral depending walls located around said cavities and extending from said upper portion to said lower surface, said upper portion being free of reinforcing elements and being supported substantially throughout its lower extremity by said wall portions, said wall portions being sufficiently wide adjacent to said upper portion to support substantially the entire lower extremity of said upper portion, said walls extending downwardly with substantially uniformly decreasing width to said lower surface and being free of reinforcing elements except substantially adjacent to said lower surface, said body and grid cooperating so that loads applied to said upper surface produce compressive stresses in said concrete-like material without any significant tensile stresses and produce tensile stresses in said elements of said grid without any significant compressive stresses, the strength of said panel with respect to said loads on said upper surface being substantially the same as a similar panel without said cavities.

2. An elevated floor comprising a plurality of rectangular panels as set forth in claim 1 abutting along their edges with the upper surfaces thereof substantially coplanar to define a floor, and a plurality of pedestals supporting said panels at said corners.

3. A rectangular floor panel as set forth in claim 1 wherein said upper surface and said lower surface are substantially parallel.

4. A generally rectangular floor panel as set forth in claim 1 wherein said cavities are pyramid shaped.

5. A generally rectangular floor panel as set forth in claim 1 wherein said arrays are formed of a first cross section and said grid includes border elements having substantially greater cross section.

6. A generally rectangular floor panel as set forth in claim 5 wherein said grid includes diagonal elements at the corners of said panel to provide additional strength at such corners.

7. A generally rectangular floor panel as set forth in claim 5 wherein each of said border elements extends along one side of said panel and provides end portions which extend diagonally inwardly from adjacent corners, the adjacent of said end portions being welded together.

8. A floor panel as set forth in claim 1 wherein said floor panel is substantially square, said zones are substantially square, and said cavities are pyramids having substantially a square base.

9. A floor panel as set forth in claim 8 wherein the thickness of said upper portion is no greater than about one fifth the thickness of said body, and said walls have a height at least about four fifths of the thickness of said body.

10. A floor panel as set forth in claim 8 wherein said cavities have a width at their lower surface less than about twice the thickness of said body.

* * * * *